US006827097B2

(12) United States Patent
Goodman

(10) Patent No.: US 6,827,097 B2
(45) Date of Patent: Dec. 7, 2004

(54) WATER COOLER DRIP TRAY DRAINAGE APPARATUS

(76) Inventor: Charles S. Goodman, 158 Golden Rd., Stoughton, MA (US) 02368

( * ) Notice: Subject to any disclaimer, the term of this patent is extended or adjusted under 35 U.S.C. 154(b) by 0 days.

(21) Appl. No.: 10/634,059

(22) Filed: Aug. 4, 2003

(65) Prior Publication Data

US 2004/0026449 A1 Feb. 12, 2004

Related U.S. Application Data

(63) Continuation-in-part of application No. 10/213,240, filed on Aug. 6, 2002, now Pat. No. 6,679,400.

(51) Int. Cl.[7] ..... F04D 9/00
(52) U.S. Cl. ..... 137/197; 222/108
(58) Field of Search ..... 222/108, 185.1; 137/312, 197, 550

(56) References Cited

U.S. PATENT DOCUMENTS 2,144,004 A 1/1939 Wilson
3,575,521 A * 4/1971 Porter et al. ..... 137/197
4,194,651 A 3/1980 Martin et al.
5,819,784 A 10/1998 Yoon

* cited by examiner

*Primary Examiner*—Philippe Derakshani
(74) *Attorney, Agent, or Firm*—Altman & Martin

(57) ABSTRACT

A water cooler with a drip tray in which liquid in the drip tray drains through a drain hole connected to a pump. When liquid is detected, the pump activates to pump the liquid to a remote drain. An optional filter between the drip tray and the pump traps overly-large particles. Optionally, the drip tray is covered by a removable strainer. A vent in the hose between the drip tray and pump includes a pressure relief vent. Optionally, an access point between the drip tray and vent provide drainage for another source of liquid. The pump is activated by a sensor that detects the presence of liquid in the inlet hose and remains on for a period after liquid is no longer detected so that the liquid is pumped the full distance to the drain.

18 Claims, 4 Drawing Sheets

WATER COOLER DRIP TRAY DRAINAGE APPARATUS

CROSS-REFERENCES TO RELATED APPLICATIONS

The present application is a continuation-in-part application of application Ser. No. 10/213,240, dated Aug. 6, 2002 now U.S. Pat. No. 6,679,400 for WATER COOLER DRIP TRAY DRAINAGE APPARATUS in the name of Charles S. Goodman.

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to drinking water dispensers, more particularly, to a mechanism for automatically draining a water cooler drip tray.

2. Description of the Related Art

Water coolers are standard fixtures in many offices and homes. They come in two varieties, with a bottle and without a bottle. Both types of water coolers have typically one, two, or three spigots above a drip tray. The drip tray catches water dripping from the spigots, overflowing from the container being filled, etc. There is typically no mechanism for actively emptying the drip tray; it is emptied either by evaporation or by someone physically emptying it. Water collecting in the drip tray for any length of time becomes stagnant, leading to problems of the drip tray becoming dirty and emitting odors. Bacteria, molds, and other undesirable organisms may grow, causing potential health hazards.

BRIEF SUMMARY OF THE INVENTION

An object of the present invention is to provide a mechanism for actively emptying the drip tray of a water cooler.

The water cooler of the present invention has a housing with a water reservoir, one or more spigots, and a drip tray. Liquid in the drip tray drains through a drain hole connected to a pump. When liquid is detected, the pump activates to pump the liquid to a remote drain.

Several configurations of the drip tray receptacle are contemplated, including, but not limited to, a generally rectangular shape, a bowl shape, and an pyramid or cone shape. At the bottom of the drip tray is a drain hole. An optional filter prevents overly-large particles from entering the drain hole, potentially causing blockages. One filter embodiment includes a vertical rigid pipe with a plurality of side wall apertures through which the liquid drains, where the size of the apertures determines the size of the particles that are allowed past the filter. Another filter embodiment includes a fine mesh at the drain hole. Another filter embodiment includes a set of small holes that constitute the drain hole. Another filter embodiment includes a filter in-line between the drain hole and the pump. Optionally, the drip tray is covered by a removable coarse strainer. When used with the first filter embodiment, the strainer optionally includes a plug that fits into the upper opening of the filter pipe to hold the strainer in place.

The electric pump must be capable of operating without being damaged when there is no liquid and when there are small suspended particles of foreign matter. The pump is preferably located inside the housing, but external locations are also contemplated. An inlet hose connects the drain hole to the pump and an outlet hose routes the pump outlet to an existing drain. The inlet hose includes a pressure relief vent to relieve air pressure caused by the weight of the water. Optionally, the inlet hose is long enough to permit the drip tray to be lifted from the housing for cleaning without having to be disconnected. Optionally, the inlet hose includes an access point for another source of water for drainage. Preferably, the pump is activated by a sensor that detects the presence of liquid in the inlet hose. The pump remains on for a period after liquid is no longer detected so that the liquid is pumped the full distance to the drain.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
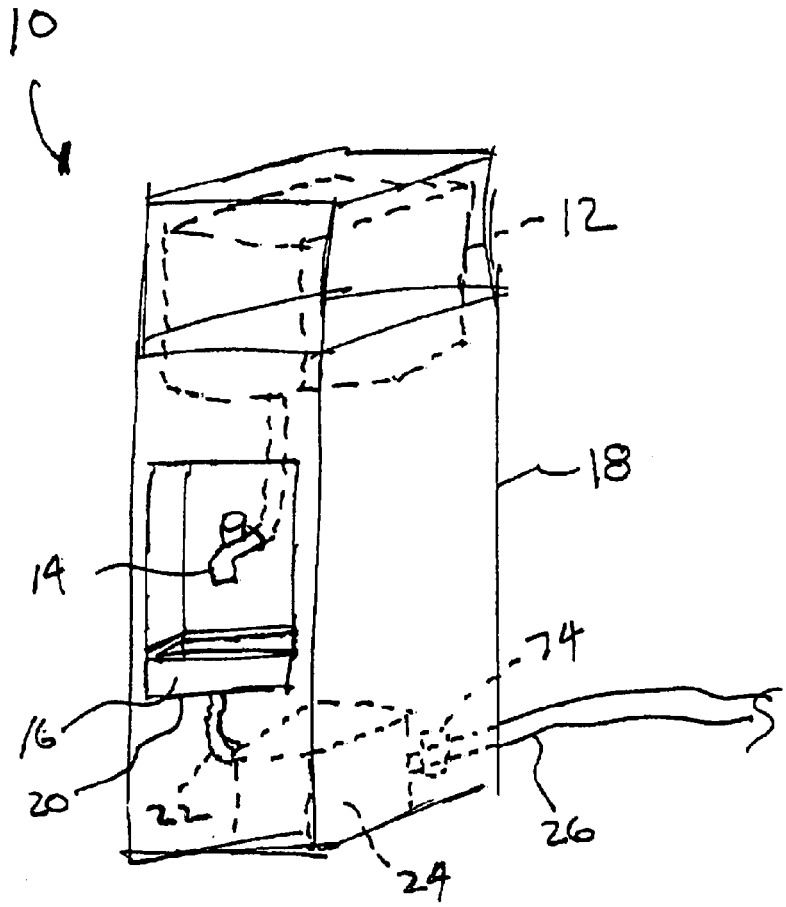
FIG. 1 is a perspective view, partially in phantom, of a no-bottle water cooler incorporating the present invention.

A typical water cooler 10 incorporating the present invention is shown in FIG. 1. The water cooler 10 has a housing 18 within which is a reservoir 12 of potable water, one or more spigots 14, and a drip tray 16. The reservoir 12 may be external, as with bottled water coolers, or internal, as with no-bottle water coolers. Water coolers 10 typically have one or more of three types of spigots 14: room temperature water, heated water, and chilled water.

In short, when liquid is detected in the drip tray 16, a pump 22 is activated to draw the liquid from the drip tray 16, through an inlet hose 22, the pump 24, and an outlet hose 26, to an existing drain 28.

The drip tray 16 sits below the spigots 14 to catch water that may drip or run from the spigots 14, overflow from the container being filled, etc. The drip tray 16 is typically an independent receptacle 30, with an open top 32 for the liquid to fall into, that fits into a seat 20 below the spigots 14 such that it can be removed for cleaning, repair, or replacement. Alternatively, the receptacle 30 is integrated with the housing 18 and is not removable.

Figure 2:
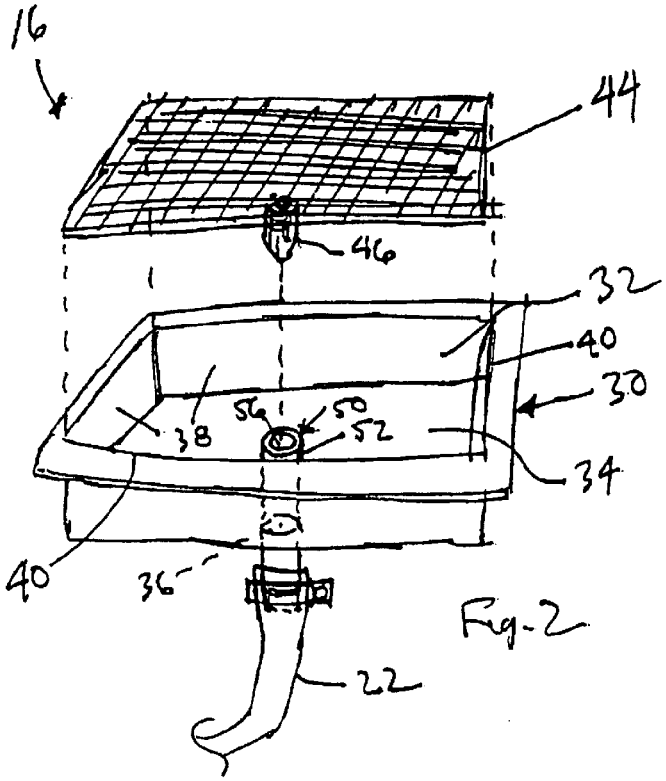
FIG. 2 is a perspective, exploded view of one configuration of the drip tray.
Figure 3:
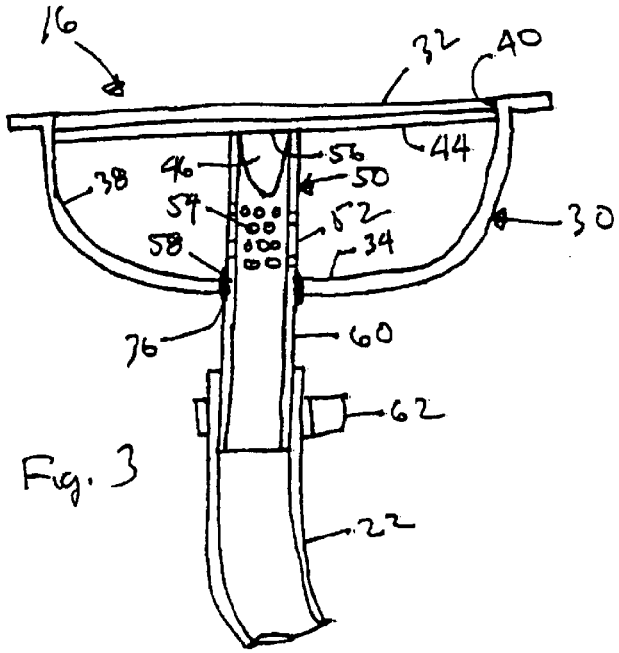
FIG. 3 is a cross-sectional view of another configuration of the drip tray showing one embodiment of the filter.

The receptacle floor 34 has a drain hole 36 through which water drains. The drain hole 36 may be a single hole or a group of smaller holes. Optionally, the floor 34 is concave, with the drain hole 36 at the lowest point, so that water does not pool anywhere in the receptacle 30. In one configuration, the receptacle 30 takes the form of a generally rectangular compartment with vertical walls 38 and a floor 34, as in FIG. 2. In another configuration, the receptacle 30 is bowl-shaped, that is, the walls 38 curve from vertical at the top edge 40 of the receptacle 30 to the opening 32, as in FIG. 3. In another configuration, the receptacle 30 has flat walls that slope from the top edge to the opening 32, as in FIG. 4. These receptacle shapes are merely illustrative and are intended to convey that the present invention contemplates any shape that directs water to the opening 32 without leaving pools of the water in the receptacle 30.

The receptacle 30 may be deep or shallow. The depth will be designed to deal with the amount of water expected at one time. For example, if the drip tray 16 is only expected to have to deal with a dripping spigot or the occasional small spill, the receptacle 30 can be shallow. On the other hand, if it is expected that larger amounts of liquid will be poured into the drip tray, for example, from a coffee maker or other large container, the receptacle 30 can be made larger to accommodate the large amount of liquid while the pump 24 works to empty the receptacle 30. The size of the receptacle 30 should be designed with the pump capacity in mind.

The system optionally includes a filter 50 that prevents larger particles from potentially blocking the hoses 22, 26 or harming the pump 24. Several filter embodiments are shown in FIGS. 2–6. The filter 50 of FIGS. 2 and 3 takes the form of a rigid pipe 52 with apertures 54 through which the liquid drains. The pipe 52 extends from the drain hole 36 upwardly to the top or near the top of the receptacle 30. The present invention contemplates that the pipe 52 may be formed with the receptacle 30 or formed separately from the receptacle 30 and installed in the drain hole 36. In the latter case, a watertight seal is formed between the drain hole 36 and pipe 52, as at 58, to prevent liquid from leaking outside of the system. The size of the apertures 54 determines the size of the particles that are allowed past the filter 50. The upper end 56 of the pipe 52 is closed to prevent large particles from inadvertently entering the pipe 52. The closure may be permanent in that, for example, the pipe 52 may be formed with a closed end or the pipe 52 is closed by a permanently attached cap. Alternatively, the pipe 52 may be closed with a removable plug, for example, the plug described below with reverence to the strainer 44.

Figure 4:
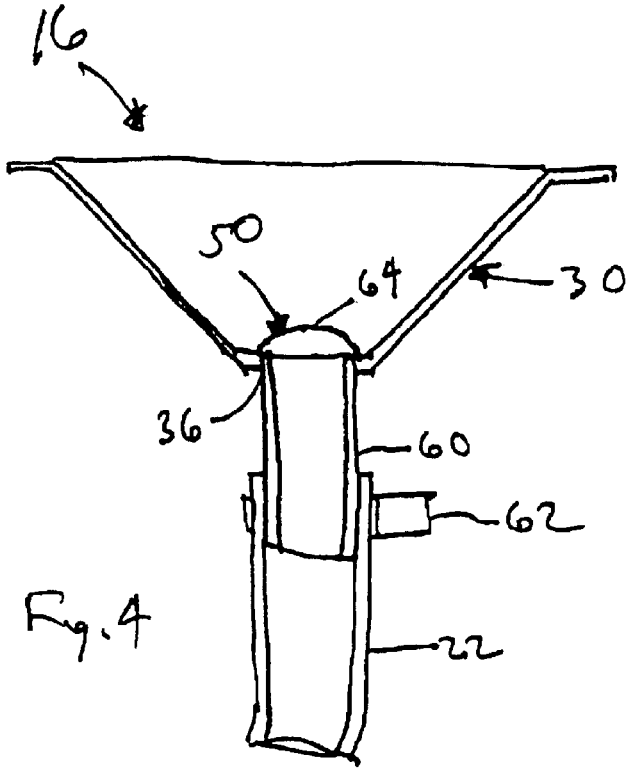
FIG. 4 is a cross-sectional view of another configuration of the drip tray showing a second embodiment of the filter.

The second form of filter 50 is shown in FIG. 4 as a fine mesh 64 at the drain hole 36. The fineness of the mesh 64 determines the size of the particles that are allowed past the filter 50.

Figure 5:
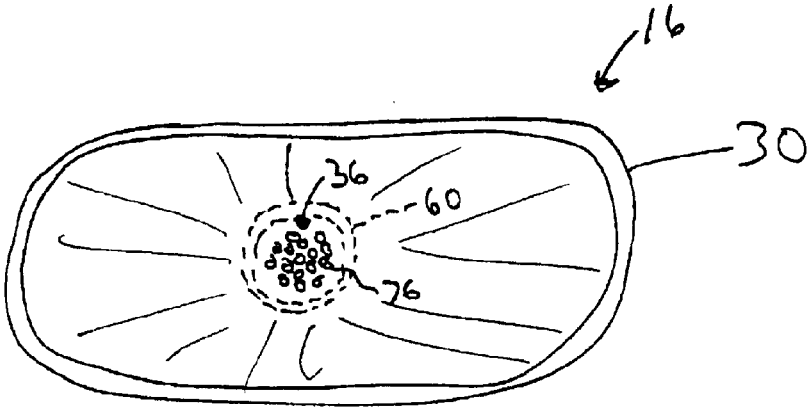
FIG. 5 is a top view of another configuration of the filter showing a third embodiment of the filter.

The third form of filter 50 is shown in FIG. 5 as a set of small holes 76 formed in the bottom of the receptacle 30 that combine to form the drain hole 36. The size of the small holes 76 determines the size of the particles allowed through the drain hole 36.

Figure 6:
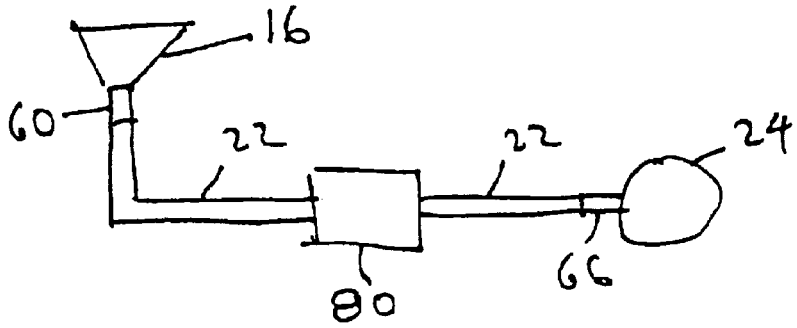
FIG. 6 is a perspective view of the inlet hose with an in-line filter.

The fourth form of filter 50 is shown in FIG. 6 as an in-line filter 80 located in the inlet hose 22 between the drip tray 16 and the pump 24. Preferably, the in-line filter 50 is accessible for cleaning and replacing when needed. There are a number of such in-line filters known in the art, and all are contemplated for use in the present invention.

The present invention contemplates that one or more types of filters may be employed in one water cooler, either separately or in combination.

Optionally, the open top 32 is covered by a coarse strainer 44, such as a screen, to prevent larger particles from being pulled into the pumping system, potentially blocking the hoses 22, 26 or harming the pump 24. The strainer 44 may be positioned at the rim 40 of the opening 32 itself, or it may be positioned below the level of the rim 40 so that the upper portion of the receptacle walls 38 function as a splash guard. Preferably, the strainer 44 is removable for replacement or so that the inside of the drip tray 16 can be cleaned. When used with the filter 50 of FIGS. 2 and 3, the strainer 44 optionally includes a plug 46 that fits into the upper end 56 of the filter pipe 52 to hold the strainer 44 in place and to prevent large particles from entering the pipe 52.

The pump 24 is electric. The small amount of liquid that will typically have to be drained provide the basis for the requirement that the pump 24 be capable of operating without being damaged when there is no liquid. It is preferred that the pump 24 be able to handle liquid with small suspended particles of foreign matter, in the event that such particles get past any filtering that may be present. The present invention contemplates that any pump that meets these requirements can be used. Example of acceptable pumps types include peristaltic pumps and diaphragm pumps.

The pump 24 is preferably located inside the water cooler housing 18. This location provides the most protection for the pump 24 from the outside environment. The actual location within the water cooler 10 is determined by the particular design of the water cooler 10. For example, if the water cooler 10 only provides room temperature water, there will be many more possible locations for the pump 24 than if the water cooler 10 includes a heating unit and refrigeration unit for providing heated and chilled water.

The present invention also contemplates that the pump 24 may be located in an enclosure attached to the outside of the water cooler 10. This mounting may be necessary or desirable when retrofitting an existing water cooler 10 and there is not adequate or appropriate space within the water cooler housing 18 for the pump 24.

The receptacle 30 and pump 24 are connected by an inlet hose 22, preferably a flexible tube. The inlet hose 22 is attached to the receptacle opening 36 at a rigid nozzle 60 and to the pump 24 at the pump inlet 66 by hose clamps 62. When implementing the filter 50 of FIGS. 2 and 3, the nozzle 60 is preferably a downward extension of the rigid pipe 52. When implementing the filter 50 of FIG. 4, the nozzle 60 is a pipe extending downwardly from the drain hole 36. The hose clamps 62 permit easy disassembly for maintenance purposes. The inside diameter of the inlet hose 22 is chosen to provide an efficient flow for the expected volume of water.

Figure 7:
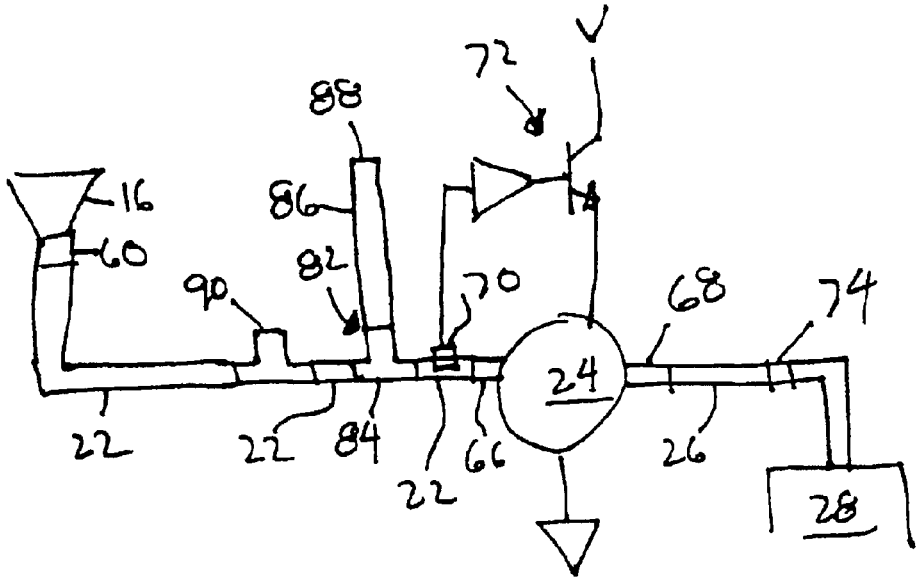
FIG. 7 is a basic electrical and hydraulic schematic of the present invention.

As shown in FIG. 7, the inlet hose 22 includes a pressure relief vent 82 just before the pump 24. When the pump 24 is not operating, the air in the inlet hose 22 is compressed by water flowing down the inlet hose 22. For some amounts of water, the compressed air will offset the weight of the water, suspending the water in the inlet hose 22 so that the pump 24 will not be triggered. The vent 82 relieves the air pressure so that the water can flow to the pump 24 regardless of the amount of water. The vent 82 is a tap from the inlet hose 22 adjacent to the pump 24 and before the sensor 70 described below. The vent 82 typically includes a T-shaped connector 84 and a hose 86. The hose end 88 is open to the air and is vertically displaced from the pump 24 enough so that water does not flow from the vent 82 rather than into the pump 24 before the pump 24 is triggered.

Optionally, the inlet hose 22 is provided with enough length so that the drip tray 16 can be lifted from its seat 20 for cleaning without having to be disconnected. There is enough space within the housing 12 for the inlet hose 22 to be pushed back in when the drip tray 16 is replaced in the seat 20.

Optionally, the inlet hose 22 includes an access point 90 for another source of water to be drained, as shown in FIG. 7. This access point is located before the vent 82. One example of another source of drainage water is a reverse osmosis filter used in some water coolers. The reverse osmosis filter relies on a constant flow of water to operate. When the reservoir of filtered water is full, the overflow water from the filter is routed to the inlet hose 22 via the access point 90.

An outlet hose 26 connects the pump outlet 68 to the drain 28, either directly or indirectly through a fitting 74 on the housing 18. The outlet hose 26 can be any form of liquid conveying hose that is appropriate for the application. For example, the outlet hose 26 may be plastic or copper, the two most common materials for water pipes. The length of the outlet hose 26 is determined by the distance from the water cooler 10 to the drain 28.

Preferably, the pump 24 is activated by a sensor 70 that detects the presence of liquid. Possible sensors include a water level sensor in the receptacle 30 and a moisture sensor in the inlet hose 24. The location of the sensor 70 will be determined by the topology of the system. A block diagram of a control circuit 72 is shown in FIG. 7. Circuits of this type are well known in the art. The sensor 70 detects the condition it is intended to sense, for example, liquid in the drip tray 16 or liquid in the inlet hose 22, and triggers the pump 24. The pump 24 remains on for a period of time beyond the point where the condition no longer exists. For example, if the sensor 70 detects water in the inlet hose 22 near the drip tray 16, the pump 24 is kept on for the amount of time needed for the water to travel the entire distance of the outlet hose 26, which may be seconds or minutes, depending upon the length of the outlet hose 26.

Thus it has been shown and described a water cooler that has a drip tray drainage apparatus which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

I claim:

1. A water cooler comprising:

(a) a housing;

(b) a water source;

(c) at least one spigot in said housing fed by said water source;

(d) a drip tray in said housing below said at least one spigot, said drip tray including a receptacle having a floor, walls, open top, and a drain hole in said floor;

(e) a pump having an inlet and outlet, said inlet operatively connected to said drain hole by an inlet hose and said outlet operatively connected to a drain by an outlet hose;

(f) a pressure relief vent in said inlet hose; and (g) a control circuit with a sensor for activating said pump when liquid is present in said inlet hose.

2. The water cooler of claim 1 wherein said inlet hose includes a filter to prevent passage of particles of a predetermined and larger size into said pump.

3. The water cooler of claim 1 wherein said drain hole is composed of a plurality of small holes sized to prevent passage of particles of a predetermined and larger size through said drain hole.

4. The water cooler of claim 1 wherein said drip tray includes a strainer covering said open top.

5. The water cooler of claim 1 wherein said drip tray is removable from said housing and said inlet hose is long enough to permit said removal without disconnecting said inlet hose.

6. The water cooler of claim 1 wherein said inlet hose includes an access point for another source of liquid for drainage.

7. The water cooler of claim 1 wherein said pump is activated for a predetermined period of time after said sensor no longer detects the presence of liquid.

8. The water cooler of claim 1 wherein said pump is a peristaltic pump or a diaphragm pump.

9. A water cooler comprising:

(a) a housing;

(b) a water source;

(c) at least one spigot in said housing fed by said water source;

(d) a drip tray in said housing below said at least one spigot, said drip tray including a receptacle having a floor, walls, open top, and a drain hole in said floor;

(e) a pump having an inlet and outlet, said inlet operatively connected to said drain hole by an inlet hose and said outlet operatively connected to a drain by an outlet hose, said pump being a peristaltic pump or a diaphragm pump;

(f) a pressure relief vent in said inlet hose;

(g) an in-line filter in said inlet hose to prevent passage of particles of a predetermined and larger size into said pump; and (h) a control circuit with a sensor for activating said pump when liquid is present in said inlet hose.

10. The water cooler of claim 9 wherein said drip tray includes a strainer covering said open top.

11. The water cooler of claim 9 wherein said drip tray is removable from said housing and said inlet hose is long enough to permit said removal without disconnecting said inlet hose.

12. The water cooler of claim 9 wherein said inlet hose includes an access point for another source of liquid for drainage.

13. The water cooler of claim 9 wherein said pump is activated for a predetermined period of time after said sensor no longer detects the presence of liquid.

14. A water cooler comprising:

(a) a housing;

(b) a water source;

(c) at least one spigot in said housing fed by said water source;

(d) a drip tray in said housing below said at least one spigot, said drip tray including a receptacle having a floor, walls, open top, and a drain hole in said floor, said drain hole being comprised of a plurality of small holes, said small holes being sized to prevent passage of particles of a predetermined and larger size through said drain hole;

(e) a pump having an inlet and outlet, said inlet operatively connected to said drain hole by an inlet hose and said outlet operatively connected to a drain by an outlet hose, said pump being a peristaltic pump or a diaphragm pump;

(f) a pressure relief vent in said inlet hose; and (g) a control circuit with a sensor for activating said pump when liquid is present in said inlet hose.

15. The water cooler of claim 14 wherein said drip tray includes a strainer covering said open top.

16. The water cooler of claim 14 wherein said drip tray is removable from said housing and said inlet hose is long enough to permit said removal without disconnecting said inlet hose.

17. The water cooler of claim 14 wherein said inlet hose includes an access point for another source of liquid for drainage.

18. The water cooler of claim 14 wherein said pump is activated for a predetermined period of time after said sensor no longer detects the presence of liquid.

* * * * *